United States Patent [19]

Caskey et al.

[11] Patent Number: 4,871,018

[45] Date of Patent: Oct. 3, 1989

[54] PLUGGING APPARATUS FOR A GRAVEL PACKER

[75] Inventors: Kenneth D. Caskey, Duncan, Okla.; Scott MacLaughlin, Palm Beach Gardens, Fla.

[73] Assignee: Halliburton Company, Duncan, Okla.

[21] Appl. No.: 213,758

[22] Filed: Jun. 30, 1988

[51] Int. Cl.[4] ..... E21B 33/12

[52] U.S. Cl. ..... 166/142; 166/181; 166/188

[58] Field of Search ..... 166/114, 116, 123, 135, 166/142, 181, 182, 188, 192

[56] References Cited

U.S. PATENT DOCUMENTS

| | | | |
|---|---|---|---|
| 3,559,732 | 2/1971 | Tucker | 166/114 |
| 4,418,754 | 12/1983 | Stepp | 166/278 |
| 4,469,173 | 9/1984 | Gilbert et al. | 166/188 |
| 4,493,374 | 1/1985 | Magee, Jr. | 166/382 |
| 4,583,593 | 4/1986 | Zunkel et al. | 166/382 |
| 4,627,488 | 12/1986 | Szarka | 166/51 |
| 4,627,491 | 12/1986 | Zunkel | 166/126 |
| 4,628,993 | 12/1986 | Zunkel | 166/51 |
| 4,633,943 | 1/1987 | Zunkel | 166/51 |
| 4,633,944 | 1/1987 | Zunkel et al. | 166/51 |
| 4,635,716 | 1/1987 | Zunkel | 166/51 |
| 4,638,860 | 1/1987 | Magee, Jr. et al. | 166/114 |
| 4,662,453 | 5/1987 | Brisco | 166/387 |
| 4,671,352 | 6/1987 | Magee, Jr. et al. | 166/186 |

OTHER PUBLICATIONS

Arrowdrill seal bore packer manufactured by Arrow Oil Tools in Tulsa, Ok.
Pengo DHL production packer.
Pengo DHL production packer.
Brown Type 1B permanent packer manufactured by Brown-Hughes.
Halliburton Services Sales & Service Catalog No. 43, pp. 2523-2529.
Vann-Systems Catalog, pp. B30 and B31.

*Primary Examiner*—Jerome W. Massie
*Assistant Examiner*—Terry Lee Melius
*Attorney, Agent, or Firm*—James R. Duzan; Neal R. Kennedy

[57] ABSTRACT

A plugging apparatus for a gravel packer. The apparatus includes a plug comprising an operating mandrel slidably received in an outer mandrel. A collet is positioned on the outer mandrel. Actuation of the operating mandrel allows engagement of the collet with a threaded portion in the packer for locking the collet into such engagement. The plug is positioned in the packer and actuated to a locking position by use of a setting tool which has a portion press fit on a ring spring mounted on the operating mandrel. Once the collet is in the locked position, the setting tool may be removed from the ring spring. The plug may be retrieved by a retrieving tool which has a collet which engages the ring spring. The retrieving tool is used to actuate the operating mandrel to disengage the collet from the threaded portion of the packer and then to retrieve the plug from the packer.

20 Claims, 4 Drawing Sheets

FIG. IC

FIG. 3C
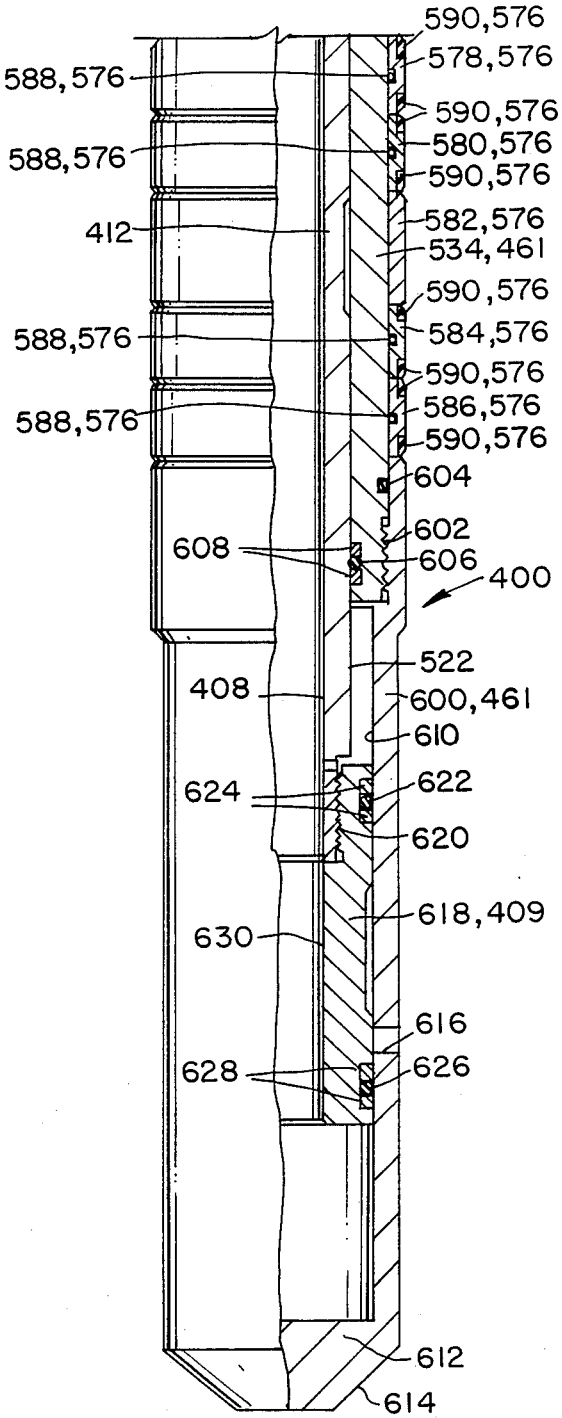
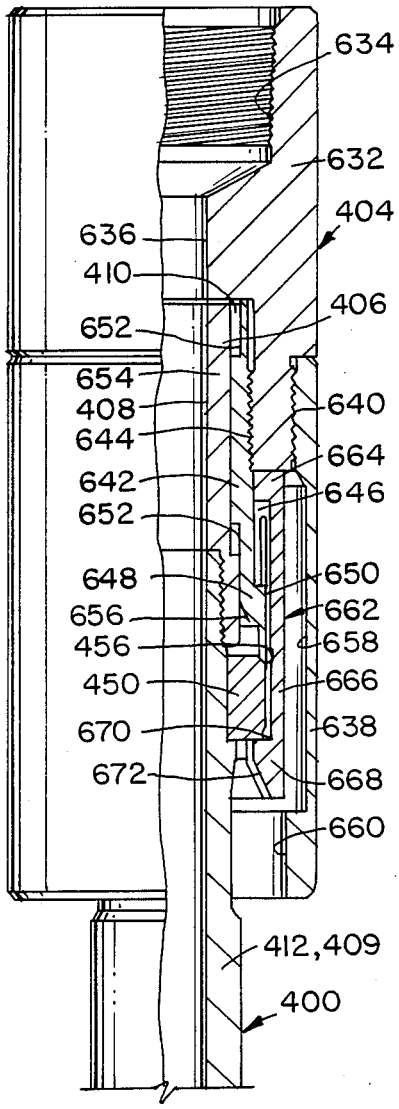
FIG. 4

PLUGGING APPARATUS FOR A GRAVEL PACKER

BACKGROUND OF THE INVENTION

1. Field Of The Invention

This invention relates to plugs for gravel packers, and more particularly, to a plug which may be positioned in a gravel packer by a setting tool and removed from the packer by a retrieving tool for later reuse.

2. Description of the Prior Art

When gravel packing a well it is desirable to minimize the number of trips downhole to operate or install tools and perform the various operations. One ideal method would be to make one trip downhole to set a sump or false bottom packer, then make one more run to set a gravel packer, perform a gravel packing operation, and remove the tool string and operating tool out of the well, leaving the gravel packer ready for production. Another desirable feature would be to enable gravel packing multiple zones within the well bore. Also, in deviated wells or in situations where the packer is set on bottom, it is desirable that the gravel packing operation be carried out without rotation of the tool string.

The gravel packer disclosed here is of the type having an inner mandrel means with a threaded portion therein, and is set by actuation of a pusher sleeve means downwardly with respect to the mandrel means for setting the packer element and slips.

It may become desirable to shut in a well below the gravel packer, such as when production is desired to be carried out at a higher gravel pack location. A plugging apparatus is needed to plug the packer so that such operations may be carried out. Also, it is desirable to plug a lower gravel packer to prevent perforating debris from an upper formation from settling on and plugging the lower gravel packer. The present invention provides a plugging apparatus including a plug which is easily set in a gravel packer of the type described by running the plug into the well bore on a setting tool. The setting tool is disengaged, leaving the plug in the gravel packer. The plugging apparatus of the present invention also provides the desirable characteristic of the plug being retrievable by running a retrieving tool into the well bore to connect to the plug, disengage the plug from the packer and retrieve both the retrieving tool and the plug from the well bore so that production may be again carried out at the packer location.

SUMMARY OF THE INVENTION

The gravel packer plugging apparatus of the present invention is adapted for plugging a packer set in a well bore and comprises collet means for engaging an inner portion of the packer, operating mandrel means for actuating the collet means and selectively locking the collet means in an engaged position and unlocking the collet means, sealing means for sealingly engaging an inner surface of the packer, and means for disconnecting the mandrel means from a tool string without disengaging the collet means.

The apparatus may further comprise filling means for providing communication between the well bore and a central opening defined in the operating mandrel means as the tool string is lowered into the well bore. Shoulder means may be provided for limiting downward movement of the operating mandrel means, and stop means provided for limiting upward movement of the mandrel means after locking engagement of the collet means with the packer. Preferably, shearing means are provided for shearably connecting the stop means to the operating mandrel means and for shearing in response to an upward force on the mandrel means, whereby the mandrel means may be actuated to unlock the collet means.

The plugging apparatus further comprises spring means adjacent to an upper end of the operating mandrel means and a setting tool attached to the tool string and defining a bore therein adapted for being press or interference fit on an outer portion of the spring means. The setting tool is detachable from the spring means upon application of a predetermined upward force on the setting tool.

The plugging apparatus further comprises a retrieving tool connected to a tool string and comprising retrieving collet means thereon for lockingly engaging the spring means for raising the mandrel means wherein the collet means is unlocked and disengaged from the packer for retrieving the plugging apparatus from the packer.

Means are provided for preventing relative rotation between the operating mandrel means and the collet means and for preventing relative rotation between the retrieving tool and the operating mandrel means.

The apparatus may further comprise means for draining when the apparatus is raised from the well bore on the retrieving tool.

The collet means may include a collet forming a portion of an outer mandrel assembly, and the operating mandrel means characterized as an inner mandrel assembly with an upper portion, an intermediate portion having a pair of spaced annular grooves in an outer surface thereof, and a lower portion. A plurality of collet supports are disposed between the inner mandrel assembly and the collet. When the inner mandrel assembly is in an engaging position, the collet supports are aligned with and biased radially inwardly into an upper one of said grooves, and when the inner mandrel assembly is raised to a locking position, the collet supports are aligned with a portion of the inner mandrel assembly between the grooves which locks the collet radially outwardly for locking engagement with the threaded portion of the packer. The inner mandrel assembly further has a disengaging position wherein the collet supports are aligned with and biased into a lower one of said grooves such that the collet may be disengaged from the threaded portion of the packer.

In one embodiment, the outer mandrel assembly defines an annular groove in an outer surface thereof, and the apparatus further comprises a shear sub slidably positioned on the outer mandrel assembly and having a first position below the groove in the outer surface and a second position, and locking dog means for lockingly engaging a groove in the outer surface when the shear sub is in the second position. Shear means may be provided for shearably connecting the shear sub and the outer mandrel assembly for shearing in response to a downward force on the outer mandrel assembly, whereby the shear sub is moved to the second position. Means may also be provided for preventing relative rotation of the shear sub and the outer mandrel assembly.

In one embodiment, the filling means is characterized by the inner mandrel assembly defining a central opening therethrough and a transverse hole therein in communication with the central opening, and the outer mandrel assembly defining a transverse hole therethrough in communication with the hole in the inner mandrel assembly such that a filling passageway is formed.

The means for draining the apparatus may be characterized by the lower portion of the outer mandrel assembly defining a transverse relief hole therethrough, the lower portion of the inner mandrel assembly being adjacent to the hole with sealing means on the lower portion of the inner mandrel assembly for sealingly closing the relief hole when in a variable first position corresponding to the engaging and locking positions of the inner mandrel assembly and a second position opening the relief hole corresponding to the disengaging position of the inner mandrel assembly.

An important object of the invention is to provide a retrievable plugging apparatus for sealingly closing a gravel packer in a well bore.

Another object of the invention is to provide a gravel packer plug which may be set by longitudinal motion of a tool string, but not requiring rotation.

A further object of the invention is to provide a setting tool for setting a plug in a gravel packer and a retrieving tool for retrieving the plug without disturbing the gravel packer.

Additional objects and advantages of the invention will become apparent as the following detailed description of the preferred embodiment is read in conjunction with the drawings which illustrate such preferred embodiment.

BRIEF DESCRIPTION OF THE DRAWINGS

FIGS. 1A–1C show a gravel packer used with the gravel packer plug of the present invention.

FIGS. 3A–3C show the gravel packer plug of the present invention with a setting tool attached thereto.

FIG. 4 illustrates connection of a retrieving tool to the gravel packer.

DESCRIPTION OF THE PREFERRED EMBODIMENT

Figure 1A:
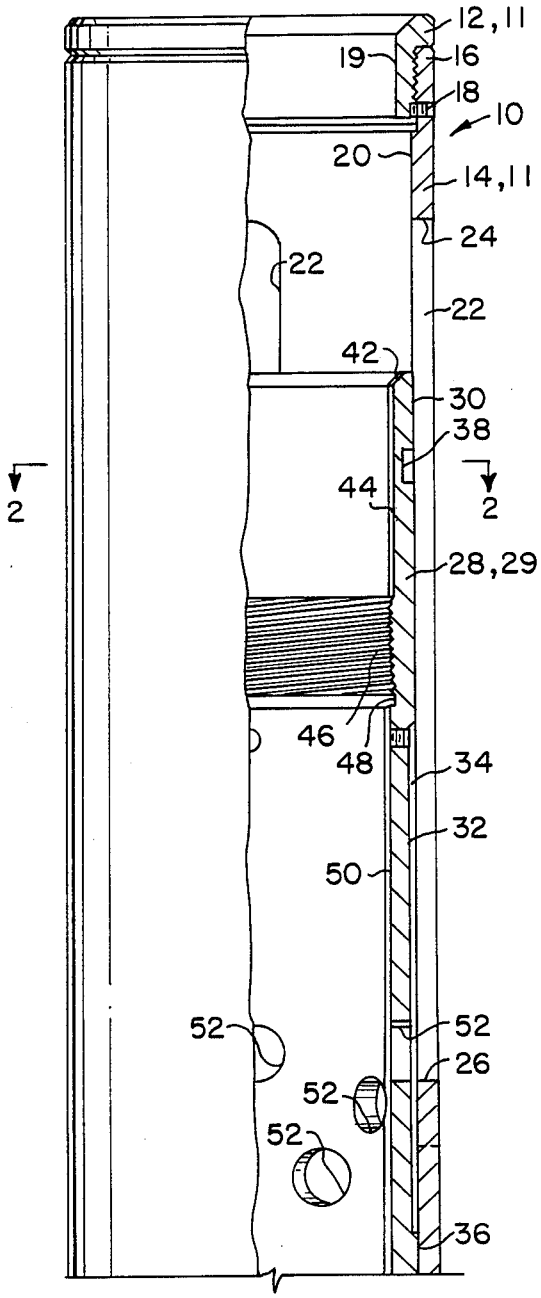
Figure 1B:
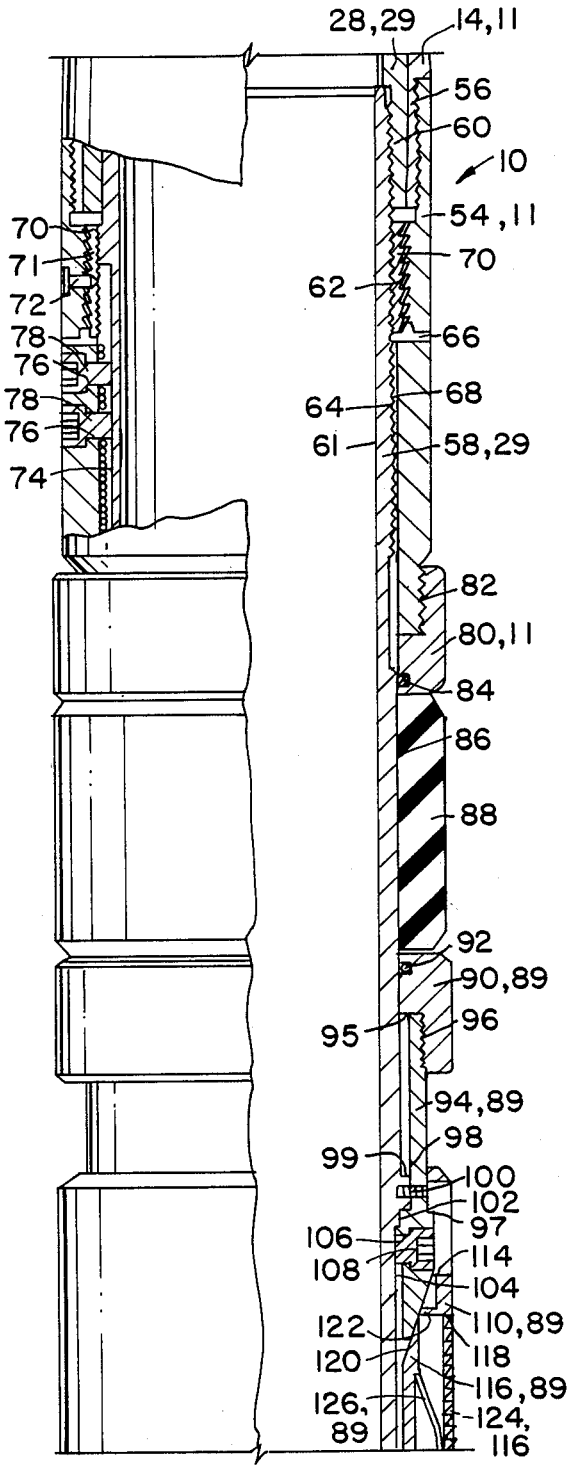
Figure 3A:
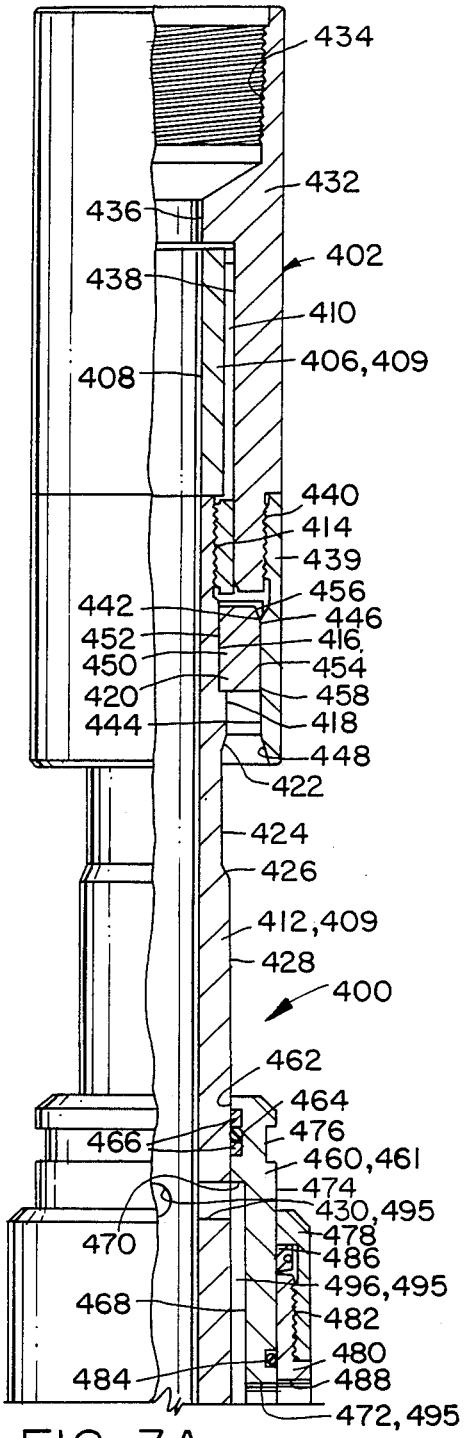
Figure 3B:
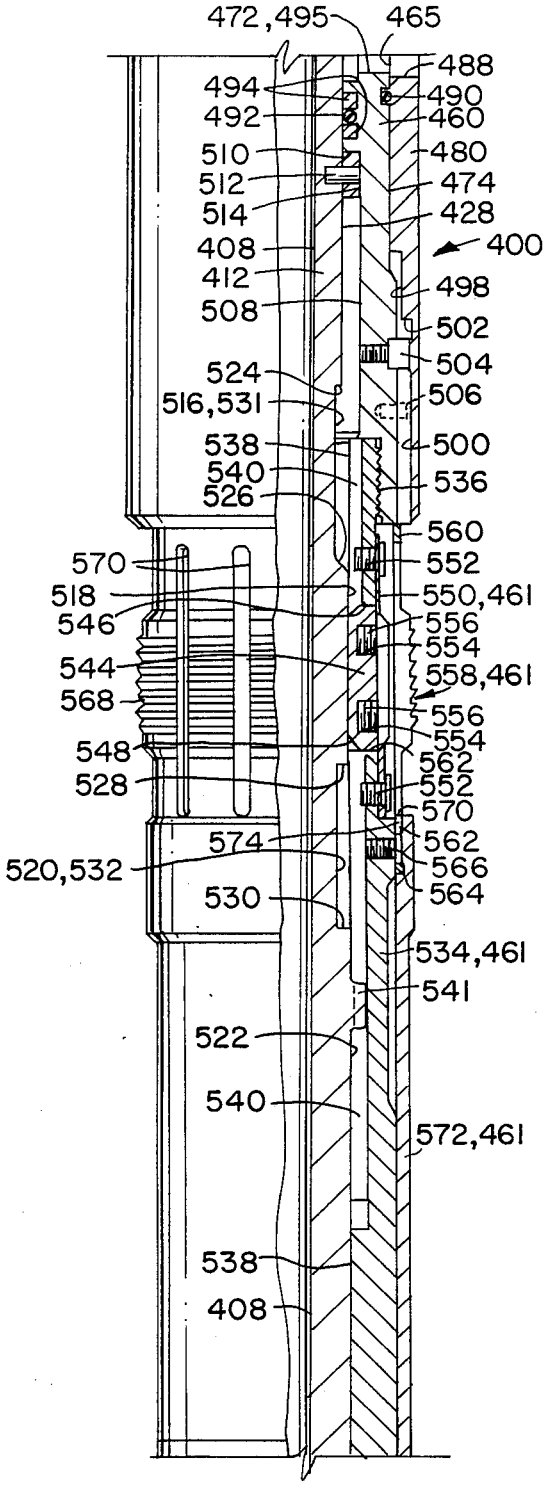

Referring now to the drawings, and more particularly to FIGS. 1A–1C, the gravel packer with which the gravel packer plug of the present invention is used, is shown and generally designated by the numeral 10. Referring to FIGS. 3A–3C, the gravel packer plug of the present invention is shown and generally designated by the numeral 400. Because gravel packer plug 400 is best understood after a familiarity with gravel packer 10, the details of gravel packer 10 will be discussed first.

DESCRIPTION OF THE GRAVEL PACKER

At the upper end of gravel packer 10 is a pusher sleeve means 11 comprising top end cap 12 engaged with pusher sleeve 14 at threaded connection 16. At least one set screw 18 locks top end cap 12 and pusher sleeve 14 together. Top end cap 12 defines a central bore 19 therethrough.

Pusher sleeve 14 defines a central bore 20 therethrough in communication with bore 19 in top end cap 12. A plurality of longitudinally extending slots are defined through pusher sleeve 14, and slots 22 will be seen to be in communication with bore 20. Each slot 22 has an upper end 24 and a lower end 26.

Slidably disposed in bore 20 of pusher sleeve 14 is a top sub 28, which forms an upper portion of a packer mandrel means 29, which may be characterized as an inner mandrel assembly 29. Top sub 28 has a first outside diameter 30 which is in close, spaced relationship to bore 20 of pusher sleeve 14, a second outside diameter 32 which is spaced radially inwardly from first outside diameter 28 such that an annular volume 34 is defined between pusher sleeve 14 and top sub 28, and a third outside diameter 36 which is substantially the same diameter as first outside diameter 30.

Figure 2:
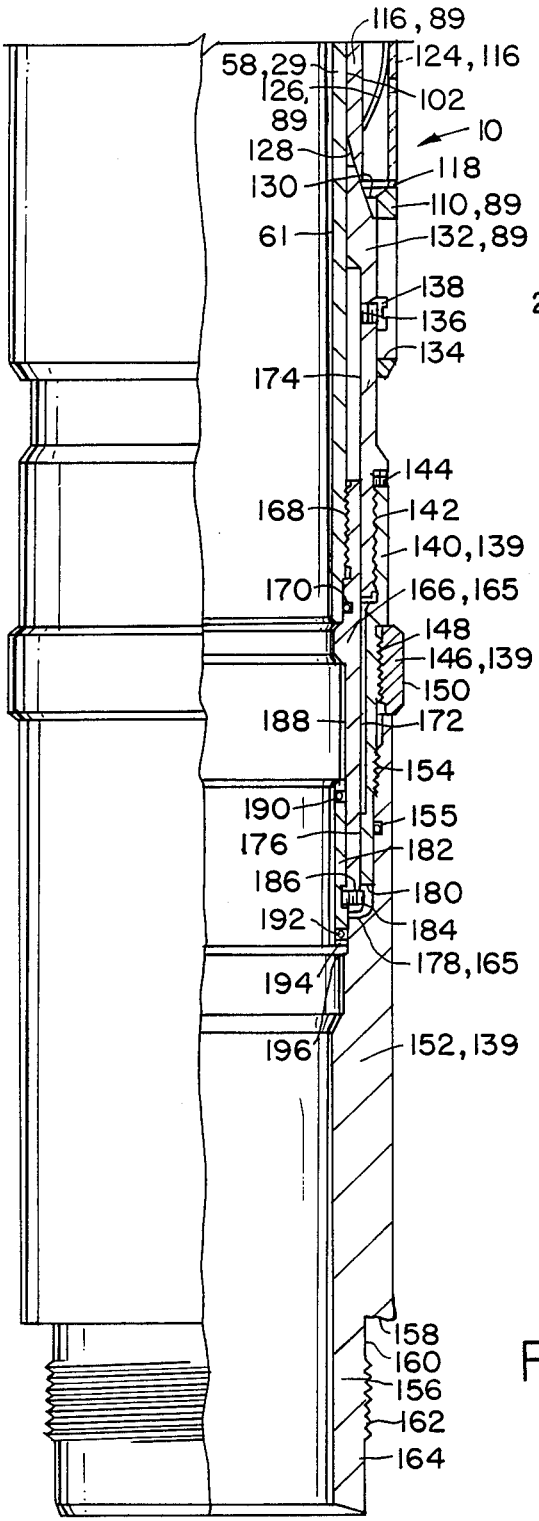
FIG. 2 is a cross section taken along lines 2—2 in FIG. 1A.
Figure 2:
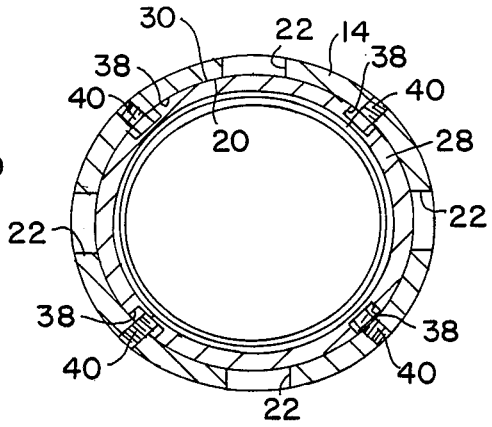

A plurality of recesses 38 are defined in first outside diameter 30 of top sub 28. Referring also to FIG. 2, it will be seen that four such recesses 38 are angularly spaced about a central axis of gravel packer 10, and are thus angularly positioned between slots 22. While four slots 22 and four recesses 38 have been shown for the purposes of this disclosure, it should be understood that the actual number may vary. Further, although a recess 38 is shown in FIG. 1A for illustration purposes, a study of FIG. 2 will show that the recess is actually angularly displaced approximately 45° from the slot 22 shown in FIG. 1A. A plurality of shear pins 40 are threaded into pusher sleeve 14, such that each shear pin 40 extends into a corresponding recess 38. Thus, shear means are provided for holding packer mandrel means 29 in the relative position with pusher sleeve means 11 as shown in FIGS. 1A and 1B.

On the inside of top sub 28 is an upwardly facing chamfer 42 at the upper end of a first bore 44. Below first bore 44 is a left-hand threaded portion 46 with an annular groove 48 therebelow. Extending downwardly from groove 48 is a second bore 50. Extending through second bore 50 are a plurality of transverse holes 52, at least one of which is substantially longitudinally aligned with a slot 22 in pusher sleeve 14 adjacent lower end 26 of the slot. Annular volume 34 insures communication between holes 52 and slots 26 even if the holes and slots are not angularly aligned about a central axis of gravel packer 10. Thus, a port means is provided between packer mandrel means 29 and a well bore in which packer 10 is positioned.

Referring now to FIG. 1B, the lower end of pusher sleeve 14 is connected to ratchet ring housing 54 at threaded connection 56. At substantially the same longitudinal location, the lower end of top sub 28 is connected to inner mandrel 58 at threaded connection 60. It will be seen that ratchet ring housing 54 forms a portion of pusher sleeve means 11, and inner mandrel 58 forms a portion of packer mandrel means 29. Inner mandrel 58 defines a central opening 61 therethrough.

Ratchet ring housing 54 has a threaded, ratcheted inner sleeve surface 62 with a bore 64 extending therebelow. At least one transverse hole 66 extends through ratchet ring housing 54 at a longitudinal location substantially between ratcheted inner surface 62 and bore 64.

Inner mandrel 58 has a ratcheted outer mandrel surface 68 thereon. It will be seen that at least a portion of ratcheted outer surface 68 on inner mandrel 58 faces ratcheted inner surface 62 in ratchet ring housing 54. An annular ratchet or lock ring 70 is disposed between inner mandrel 58 and ratchet ring housing 54, such that it is in threaded, ratcheted engagement with ratcheted inner surface 62 and in ratcheted engagement with outer surface 68. Ratchet ring 70 defines a longitudinal slot 71 therein. A bind head screw 72 extends through ratchet ring housing 54 and into slot 71 to provide a means for preventing relative rotation between ratchet ring 70 and ratchet ring housing 54.

Inner mandrel 58 defines a longitudinally extending slot 74 thereon which extends radially inwardly from ratcheted outer surface 68. Adjacent to slot 74, ratchet ring housing 54 defines a pair of transverse holes 76 therethrough. Extending through each hole 76 into slot 74 is a pin 78. Preferably, pins 78 are the form of a socket head cap screw. It will be seen by those skilled in the art that the interaction of pins 78 with slot 74 provides a means for preventing relative rotation of ratchet ring housing 54 and inner mandrel 58, and thus provides a means for preventing relative rotation between packer mandrel means 29 and pusher sleeve means 11. However, pins 78 are sized such that they are slidable within slot 74 so that relative longitudinal movement between ratchet ring housing 54 and inner mandrel 58 is possible, as further described herein.

The lower end of ratchet ring housing 54 is connected to an upper packing backup shoe 80, also referred to as upper shoe 80, at threaded connection 82. Sealing means, such as O-ring 84, provides sealing engagement between upper shoe 80 and a second outside diameter 86 of inner mandrel 58. Upper packing backup shoe 80 forms a lower portion or end of pusher sleeve means 11.

Annularly positioned around second outside diameter 86 of inner mandrel 58, and sealingly engaged therewith is a packer or sealing means, such as packer sleeve or element 88 for sealingly engaging a well bore. Packer element 88 is made of an elastomeric material known in the art.

Disposed below packer element 88 is a slip means 89 for grippingly engaging the well bore. Slip means 89 comprises a lower packing backup shoe 90, also referred to as lower shoe 90. Sealing means, such as 0-ring 92, provide sealing engagement between lower shoe 90 and second outside diameter 86 of inner mandrel 58.

Lower shoe 90 has a downwardly facing shoulder 95 therein and is attached to upper slip wedge 94 at threaded connection 96. Upper slip wedge 94 also forms a portion of slip means 89. Upper slip wedge 94 and lower packing backup shoe 90 may also be referred to as an upper slip wedge assembly. Upper slip wedge 94 has an upwardly facing shoulder 97 thereon. Upper slip wedge 94 is initially connected to inner mandrel 58 at a third outside diameter 98 thereof by a shear pin 100. An upwardly facing shoulder 99 extends between second outside diameter 86 and third outside diameter 98. As will become more clear in a reading of the discussion on the retrieval of packer 10, shoulder 99 provides a means on packer mandrel means 29 for engaging the upper slip wedge assembly during a retrieving operation, and shoulder 97 on upper slip wedge 94 provides a means on the upper slip wedge for engaging slip housing 110 during the retrieving operation after packer mandrel means 29 engages the upper slip wedge assembly.

Below shear pin 100, inner mandrel 58 has a fourth outside diameter 102 defining a longitudinally extending slot 104 therein. Upper slip wedge 94 defines a transverse hole 106 therein, and a pin 108 extends through hole 106 into slot 104. Pin 108 is preferably a socket head cap screw sized to be slidable within slot 104 such that relative longitudinal movement between upper slip wedge 94 and inner mandrel 58 is possible, as hereinafter described. However, the engagement of pin 108 with slot 104 will be seen to provide a means for preventing relative rotational movement between slip wedge 94 and inner mandrel 58, and thus a means for preventing relative rotation between slip means 89 and packer mandrel means 29.

Upper slip wedge 94 extends into slip housing 110. Slip housing 110, which is also a portion of slip means 89, has an upper slot 114 therein which allows installation of pin 108 and shear pin 100.

A plurality of slips 116 also form part of slip means 89 and are positioned in corresponding openings 118 in slip housing 110. Slips 116 define an upper, inner wedge surface 120 which engage outer wedge surface 122 on upper slip wedge 94. The radially outer portion of each slip 116 defines a knurled surface, forming a plurality of gripping teeth 124 thereon. Teeth 124 are adapted for grippingly contacting an inner surface of the well bore, as hereinafter described. Biasing means, such as a plurality of springs 126, bias slips 116 radially inwardly and form another portion of slip means 89.

Referring now to FIG. 1C, the lower end of slips 116 define a lower, inner wedge surface 128 which engages an outer wedge surface 130 on a lower slip wedge 132. Lower slip wedge 132 forms a lower portion of slip means 89.

Slip housing 110 defines a lower slot 134 therein adjacent the lower end of the slip housing. A pin, preferably in the form of a cap screw, is threadingly engaged with lower slip wedge 132 adjacent to slot 134. Lower slip wedge 132 and pin 136 may be characterized as a lower slip wedge assembly. Pin 136 has a head portion 138 which extends into slot 134 and is slidable therein. However, the engagement of head portion 138 of pin 136 with slot 134 provides a means for preventing relative rotation between slip housing 110 and lower slip wedge 132.

The lower end of lower slip wedge 132 is connected to a lower mandrel means 139 including a generally annular connector 140 at threaded connection 142. A set screw 144 prevents mutual rotation between lower slip wedge 132 and connector 140.

An annular guide ring 146 is attached to the outer surface of connector 140 at threaded connection 148 and forms a portion of lower mandrel means 139. Guide ring 146 has an outside diameter 150 which represents the maximum diameter of any of the components of gravel packer 10. Thus, as gravel packer 10 is lowered into a well bore, if there is an undersized portion of the well bore or any obstructions therein, these will first be contacted by guide ring 146. Thus, guide ring 146 provides gauging means for gauging the well bore and preventing an undersized well bore or obstructions in the well bore from damaging slip means 89 or packer element 88.

The lower end of connector 140 is attached to lower sealing mandrel 152 at threaded connection 154. Lower sealing mandrel 152 is the main component of lower mandrel means 139. Sealing means, such as O-ring 155, provides sealing engagement between lower sealing mandrel 152 and connector 140.

A lower end 156 of lower sealing mandrel 152 has a downwardly and outwardly tapered shoulder 158, a first outside diameter 160, an externally threaded surface 162, and a second outside diameter 164.

The lower end of inner mandrel 58, and thus a lower portion of packer mandrel means 29, is connected to collet means 165 including a collet body 166 at threaded connection 168. Sealing means, such as O-ring 170, provides sealing engagement between collet body 166 and inner mandrel 58. Collet body 166 has an outside diameter 172 which is slidably disposed within bore 174 of lower slip wedge 132 and bore 176 of connector 140.

At the lower end of collet body 166 are a plurality of collet fingers 178 which are held into engagement with lower shoulder 180 on connector 140 by a releasing means, such as releasing mandrel 182. A shear pin 184 extends through at least one collet finger 178 and engages a groove 186 in releasing mandrel 182. Thus, shearing means are provided for initially holding releasing mandrel 182 in the position shown in FIG. 1C.

Releasing mandrel 182 is slidably disposed in bore 188 of collet body 166. Sealing means, such as O-ring 190, provides sealing engagement between releasing mandrel 182 and collet body 166. Similarly, sealing means, such as O-ring 192, provides initial sealing engagement between releasing mandrel 182 and bore 194 in lower sealing mandrel 152. Releasing mandrel 182 has a downwardly facing shoulder 196 at the lower end thereof.

Referring now to FIGS. 3A–3C, the details of gravel packer plug 400 of the present invention will now be discussed. Gravel packer plug 400 is run into a well for engagement with gravel packer 10 by means of a setting tool 402 attached to a tool string (not shown). The tool string itself is of a kind known in the art. As will be discussed in further detail herein, plug 400 may be removed from gravel packer 10 by means of a retrieving tool 404 shown in FIG. 4 and also attached to a tool string (not shown).

At the upper end of plug 400 is a ring spring nut 406 defining a central bore 408 therethrough. Ring spring nut 406 is the uppermost component of an operating mandrel means 409, which in the embodiment shown in FIGS. 3A–3C is characterized as an inner mandrel assembly 409. The upper portion of the outside surface of ring spring nut 406 defines an external spline 410. The lower end of ring spring nut 406 is connected to the next portion of operating mandrel means 409, which is an operating mandrel 412, at threaded connection 414.

Operating mandrel 412 has a first outside diameter 416 and a somewhat larger second outside diameter 418 with an annular shoulder 420 therebetween. A tapered shoulder 422 on operating mandrel 412 interconnects second outside diameter 418 with a third outside diameter 424, and another tapered shoulder 426 interconnects third outside diameter 424 with a fourth outside diameter 428. A plurality of transverse holes 430 extend through operating mandrel 412 from central bore 408 to fourth outside diameter 428.

Setting tool 402 is used to run plug 400 into the well bore and to position the plug in gravel packer 10.

Setting tool 402 includes a top coupling 402 defining a threaded opening 434 adapted for connection to the tool string, a first bore 436 and a second bore 438 adapted to slidingly fit over spline 410 on ring spring nut 406 of plug 400. The lower end of top coupling 432 is attached to a ring spring shoulder 439 at threaded connection 440.

Ring spring shoulder 439 defines a first bore 442 and a slightly smaller second bore 444 interconnected by a tapered, annular shoulder 446. At the lower end of second bore 444 is a downwardly facing chamfered surface 448.

A ring spring 450 is annularly disposed between operating mandrel 412 and ring spring shoulder 438. Ring spring 450 has an inner bore 452 which engages first outside diameter 416 of operating mandrel 412, and ring spring 450 also engages annular shoulder 420 as shown in FIG. 3A. Ring spring 450 further has an outside diameter 454 with an upper chamfered surface 456 and a lower chamfered surface 458 extending therefrom. Ring spring 450 is preferably made from a material such as Ni-Alloy and is dimensioned and configured such that, when in the initial operating position shown in FIG. 3A, there is a slight interference or press fit between outside diameter 454 and chamfered surface 458 on ring spring 450 and shoulder 446 and possibly a portion of second bore 444 in ring spring holder 438. This interference fit is preferably such that setting tool 402 may not be longitudinally removed from plug 400 except by exerting a predetermined, longitudinal force thereon. As will be discussed further herein, in one embodiment, this predetermined force is preferably 5,000 pounds.

Still referring to FIG. 3A, gravel packer plug 400 further comprises a bypass mandrel 460 which is the upper portion of an outer mandrel assembly 461. Bypass mandrel 460 has a first bore 462 which is in slidable relationship with fourth outside diameter 428 of operating mandrel 412. A sealing means, such as O-ring 464 with backup seals 466 on either side thereof, provides sealing engagement between bypass mandrel 460 and operating mandrel 412.

Bypass mandrel 460 has a second bore 468 which is somewhat larger than first bore 462 such that an annular shoulder 470 is formed therebetween. The longitudinal relationship between operating mandrel 412 and bypass mandrel 460 is initially such that the upper edge of holes 430 in operating mandrel 412 are approximately aligned with shoulder 470 in bypass mandrel 460. At a longitudinal location below holes 430, bypass mandrel 460 defines at least one transverse hole 472 therethrough shown in FIGS. 3A and 3B. It will be seen that O-ring 464 and backup seals 466 are above holes 430 and 472.

Also in FIG. 3A, it will be seen that bypass mandrel 460 has a first outside diameter 474 with an annular groove 476 therein. Annularly positioned around bypass mandrel 460 below groove 476 is a locking dog cover 478 which is connected to a shear sub 480 at threaded connection 482. Both locking dog cover 478 and shear sub 480 are slidable with respect to bypass mandrel 460. Sealing means, such as O-ring 484, provides sealing engagement between bypass mandrel 460 and shear sub 480.

Annularly disposed in locking dog cover 478 and shear sub 480 is a locking dog means 486. Locking dog means 486 is of a kind generally known in the art and includes biasing means for biasing a plurality of locking dogs radially inwardly.

Shear sub 480 defines a substantially transverse hole 488 therethrough which is substantially aligned with hole 472 in bypass mandrel 460, as seen at the lower end of FIG. 3A and the upper end of FIG. 3B.

Still referring to FIG. 3B, sealing means, such as O-ring 490, provides sealing engagement between bypass mandrel 460 and shear sub 480. Similarly, sealing means, such as O-ring 492 with backup seals 494 on either side thereof, provide sealing engagement between bypass mandrel 460 and operating mandrel 412 below hole 472. Thus, referring to both FIGS. 3A and 3B, a flow passage 495 comprising hole 488, hole 472, an annular volume 496 between bypass mandrel 460 and operating mandrel 412, and holes 430 is formed and provides fluid communication between the outside of plug 400 and central bore 408 of operating mandrel 412, and thus to the inside of the tool string. As will be further described herein, this allows filling of plug 400, setting tool 402 and the tool string as they are lowered into the well bore.

Referring again to FIG. 3B, shear sub 480 defines a bore 498 therein and a longitudinally extending slot 500 with a downwardly facing annular shoulder 502 adjacent to the upper end of the slot.

A guide pin 504 is threadingly connected to bypass mandrel 460 and extends into, and is slidable with, slot 502. Thus, relative longitudinal movement between shear sub 480 and bypass mandrel 460 is allowed, but it will be seen that a means is provided for preventing relative rotation between shear sub 480 and bypass mandrel 460, and thus for preventing relative rotation between shear sub 480 and outer mandrel assembly 461. Preferably, guide pin 504 is in the form of a socket head set screw.

A shearing means, such as shear pin 506, provides a shearable connection between shear sub 480 and bypass mandrel 460. Shear pin 506 is angularly displaced from guide pin 504 about a central axis of plug 400. In other words, shear pin 506 does not extend into slot 500, and is therefore shown in hidden lines in FIG. 3B.

Bypass mandrel 460 defines a fourth bore 508 therein with an annular shoulder 510 at the upper end thereof. Another shearing means, such as shear pin 512 extends from operating mandrel 412 into fourth bore 508 of bypass mandrel 460. A shear pin sleeve 514 is disposed around a portion of shear pin 512 extending from operating mandrel 412. Shoulder 510 is adjacent shear pin sleeve 514 as shown in FIG. 3B. It will thus be understood by those skilled in the art that a downwardly shearable connection is provided between bypass mandrel 460 and operating mandrel 412, and thus between outer mandrel assembly 461 and operating mandrel means 409.

Below fourth outside diameter 428 on operating mandrel 412 are a fifth outside diameter 516, a sixth outside diameter 518, a seventh outside diameter 520 and an eighth outside diameter 522. A downwardly facing shoulder 524 extends between fourth and fifth diameters 428 and 516, and an upwardly facing chamfer 526 extends between fifth and sixth outside diameters 516 and 518. A downwardly facing shoulder 528 extends between sixth and seventh outside diameters 518 and 520, and an upwardly facing shoulder 530 extends between seventh and eighth outside diameters 520 and 522. As seen in FIG. 38, upper and lower spaced grooves 531 and 532 are thus defined in operating mandrel 412.

The lower end of bypass mandrel 460 is attached to a collet support housing 534 at threaded connection 536. Collet support housing 534 will be seen to form another portion of outer mandrel assembly 461. Collet support housing 534 defines a central bore 538 therethrough with a longitudinal slot 540 extending therealong. A lug 541 on operating mandrel 412 extends into slot 540 in collet support housing 534. Thus, a means is provided for preventing relative rotation between collet support housing 534 and operating mandrel 412, and thus preventing relative rotation between outer housing assembly 461 and operating mandrel means 409. It will be seen that relative longitudinal movement is still possible between outer mandrel assembly 461 and operating mandrel means 409, however.

Collet support housing 534 defines a plurality of transverse apertures 542 therethrough. Positioned in each of these apertures is a collet support 544.

Collet support 544 has a chamfered upper edge 546 and a similar, chamfered lower edge 548 A spring retainer 550, forming another portion of outer mandrel assembly 461, extends across each collet support 544 and is attached to collet support housing 534 by a pair of bolts 552 adjacent to upper and lower ends thereof. Collet support 544 defines a pair of spring cavities 554 therein, and a spring 556 is disposed in each spring cavity 554. Springs 556 bear against the inner surface of spring retainer 550 and against collet support 544, thus providing a biasing means for biasing collet support 544 radially inwardly.

A collet means, characterized in the drawings as an annular collet 558 is disposed around collet support housing 534. The collet means may also be said to form a portion of outer mandrel assembly 461. An upper end of collet 558 is radially spaced from the upper end of collet support housing 534, and a lower end 562 of the collet fits over enlarged diameter 564 on collet support housing 534. At least one bolt 566 is used to attach lower end 562 of collet 558 to collet support housing 534.

An intermediate portion of collet 558 defines a plurality of threaded, ratchet-like teeth 568 thereon, each tooth 568 having a tapered lower surface. A plurality of longitudinally extending, parallel slots 570 are defined in collet 558. Slots 570 extend through teeth 568 in the intermediate portion of collet 558. It will be seen by those skilled in the art that this allows radially inward flexibility of the intermediate portion of collet 558 with teeth 568. However, in the position shown in FIG. 3B, collet supports 544 support the intermediate portion of collet 558 so that radially inward movement is prevented.

A substantially annular collet retainer 572 forms another portion of outer mandrel assembly 461 and is positioned substantially longitudinally below collet 558 and annularly around collet support housing 534. The upper end of collet retainer 572 defines an inner recess 574 which fits around lower end 562 of collet 558 and over bolt 566.

Referring now to FIG. 3C, the components of a packer sealing means 576 are shown. Sealing means 576 comprises a pair of upper seal sleeves 578 and 580, a spacer 582 and a pair of lower seal sleeves 584 and 586. Other sealing means, such as O-rings 588, provide sealing engagement between collet support housing 534 and seal sleeves 578, 580, 584 and 586. Annular seal rings 590 are annularly disposed on the upper and lower ends of each of seal sleeves 578, 580, 584 and 586. Seal rings 590 are adapted for sealing engagement with gravel packer 10, as hereinafter described.

The lower end of collet support housing 534 is connected to a lower nose 600 at threaded connection 602. Lower nose 600 forms a closed, lower portion of outer mandrel assembly 461. Sealing means, such as O-ring 604, provides sealing engagement between collet support housing 534 and lower nose 600.

Slidable sealing engagement is also provided between the lower end of collet support housing 534 and eighth outside diameter 522 of operating mandrel 412 by a sealing means, such as O-ring 606 with backup rings 608 on either side thereof.

Lower nose 600 defines a central bore 610 therein and has a closed lower end 612. Formed on the exterior of lower end 612 is a large downwardly facing chamfered surface 614. Lower nose 600 defines at least one transverse relief or vent hole 616 therethrough at a longitudinally intermediate location thereon.

The lower end of operating mandrel 412 is attached to a lower operating mandrel or valve 618, which forms a lower end of operating mandrel means 409, at threaded connection 620. Disposed on lower operating mandrel 618 is an upper sealing means, such as O-ring 622 with backup seals 624 on either side thereof, and a lower sealing means, such as O-ring 626 with backup seals 628 on either side thereof. In the initial position shown in FIG. 3C, O-ring 622 and backup seals 624 are positioned above hole 616 in lower nose 600, and O-ring 626 and backup seals 628 are disposed below hole 616 such that hole 616 is sealingly closed by the sealing engagement of the O-ring and backup seals with central bore 610 of lower nose 600.

Lower operating mandrel 618 defines a central bore 630 therethrough which is in communication with, and preferably substantially the same size as, central bore 408 in operating mandrel 412.

OPERATION OF THE INVENTION

First, a brief description of the setting of gravel packer 10 will be provided. Gravel packer 10 is run into a well bore on a setting tool (not shown) of a kind known in the art. A threaded portion on the setting tool is initially engaged with left-hand threaded portion 46 in top sub 28 of packer 10. Attached to the lower end of gravel packer 10 on lower sealing mandrel 152 is a screen assembly (not shown) of a kind known in the art. The entire tool string is lowered into the well bore until the screen assembly is substantially adjacent to the formation to be produced. Once packer 10 is in position, a setting piston portion of the setting tool is hydraulically actuated to begin the setting of gravel packer 10. This setting piston portion engages top end cap 12 in gravel packer 10 and forces pusher sleeve 14 downwardly with respect to top sub 28. Ratchet ring 70 moves downwardly over ratcheted outer surface on inner mandrel 58. As this occurs, pins 78 slide downwardly in slot 74 and inner mandrel 58.

As this relative longitudinal motion occurs, packer element 88 starts to compress and sealing set against the well bore. As this is occurring, shear pin 100 is sheared so that slips 116 also begin to set. It will be seen that the downward portion is transmitted through packer element 88 to lower shoe 90 and thus to upper slip wedge 94. The engagement of wedge surface 122 on upper slip wedge 94 against wedge surface 120 on slips 116 causes the slips to be moved radially outwardly, overcoming the force of springs 126. As slips 116 move outwardly, wedge surface 128 on the slips slides along wedge surface 130 on lower slip wedge 132. Slips 116 are forced outwardly until teeth 124 thereon grippingly engage the well bore. Further downward force applied by the setting piston portion of the setting tool then fully sets packer element 88 into full, sealing engagement with the well bore.

Packer element 88 cannot unset from the well bore because the engagement of ratchet ring 70 with ratcheted outer surface 68 on inner mandrel 58 prevents ratchet ring 70 from moving upwardly, and thus also prevents ratchet ring housing 54 and upper shoe 80 from moving upwardly.

It will be noted that all of the setting operation for gravel packer 10 is carried out by longitudinal movement. No rotation of the tool string is required in setting the packer. After setting, the well annulus may then be pressurized to test the sealing engagement of packer element 88 with the well bore.

The tool string is then rotated to the right to back off the engagement of the threaded portion of the setting tool with left-hand threaded portion 46 in top sub 28. The setting tool may then be used for circulating operations to pack gravel around the screen assembly adjacent to the formation. The setting tool is also used for a squeezing operation and for reversing out by pumping clean-out fluid into the well annulus above packer 10. The details of these operations are not necessary for an understanding of the gravel packer plug of the present invention. These operations are described in co-pending application Ser. No. 213,203 filed 6/29/88, a copy of which is incorporated herein by reference.

Gravel packer plug 400 is run into a well bore on setting tool 402 at the end of a tubing string. As plug 400 is run into the well bore, the plug, setting tool 402 and the tubing string fill through bypass flow passage 495 hereinbefore described.

Plug 400 fits through the center of gravel packer 10 such that seal rings 590 of collet sealing assembly 576 sealingly engage central bore 61 in inner mandrel 58 of packer 10. Because lower nose 600 has a closed lower end 612, it will be seen by those skilled in the art that gravel packer 10 is thus sealingly closed below seal rings 590. In other words, the central opening through packer 10 is closed, and therefore the screen assembly attached to the lower end of packer 10 is closed so that fluid is no longer free to flow out of the well formation adjacent to the screen assembly.

As plug 400 is inserted into gravel packer 10 on setting tool 402, teeth 568 on collet 558 begin to engage left-hand threaded portion 46 in top sub 28 of the packer. However, as plug 400 is run into the well bore, operating mandrel 412 is in the position shown in FIG. 3B such that collet supports 544 lock collet 558 outwardly. In this position, collet 558 cannot move further downwardly to engage threaded portion 46. At about the same point that this occurs, the lower end of shear sub 480 engages the upper end of top end cap 12 in packer 10. Thus, shear sub 480 is prevented from further downward movement.

Additional downward force applied by the tool string on setting tool 402 will move operating mandrel means 409 downwardly to an engaging position such that upper groove 531 is positioned adjacent collet supports 544. When this occurs, springs 556 will bias collet supports 544 radially inwardly into groove 531. It will be seen that collet 558 is thus free to flex radially inwardly so that the collet may be engaged with threaded portion 46 in packer 10. Lower operating mandrel 618 bottoms out on lower end 612 of lower nose 600, and it will be seen that further downward force on operating mandrel means 409 applies a downward force on outer mandrel assembly 461. Thus, operating mandrel 461 is forced downwardly such that shear pins 506 are sheared and collet 558 is engaged with threaded portion 46.

As outer mandrel assembly 461 is thus moved downwardly, groove 476 in bypass mandrel 460 is brought adjacent to locking dog means 486 such that the locking dog means snaps into groove 476 and locks outer mandrel assembly 461 to shear sub 480. When this occurs, it will be seen that a positive shoulder means is provided to give the operator an indication at the surface that the maximum downward position of the tool string has been reached.

Collet 558 may be locked into position by then lifting on the tool string which raises setting tool 402 and operating mandrel means 409 such that sixth outside diameter 518 of operating mandrel 412, which is the portion of the operating mandrel between upper groove 531 and lower groove 532, is placed radially inwardly of collet supports 544 which thus lock collet 558 into engagement with threaded portion 46 in packer 10. This corresponds to a locking position of operating mandrel 412. The shearable stop means provided by the engagement of shear pin sleeve 514 with shoulder 510 and operating mandrel 460 limits the upward movement of operating mandrel means 409.

Thus, it will be seen that plug 400 is in locking and sealing engagement with gravel packer 10. At this point, setting tool 402 may be disengaged from plug 400. This is accomplished by raising the tool string with sufficient force to break the interference fit between setting tool 402 and ring spring 450. As already indicated, this lifting force is preferably approximately 5,000 pounds. However, the important consideration is that the force required to break the interference fit is less than the force required to shear shear pin 512.

When it is desired to restart production operations from gravel packer 10, packer plug 400 may be retrieved. Referring now to FIG. 4, retrieving tool 404 is disclosed. Retrieving tool 404 comprises a top coupling 632 having a threaded opening 634 and the upper end thereof adapted for connection to a tubing string (not shown) of a kind known in the art. Top coupling 632 defines a central bore 636 therethrough which is approximately the same size as bore 408 in ring spring nut 406. The outside lower end of top coupling 632 is attached to a collet support 638 at threaded connection 640. The inside lower end of top coupling 632 is attached to a collet retainer 642 at threaded connection 644.

Collet retainer 642 has a first outside diameter 646, below which is an enlarged annular portion 648 having a second outside diameter 650. Collet retainer 642 has an inner surface 652 with a longitudinally extending lug 654 thereon. At the lower end of inside surface 652, and formed on enlarged portion 648, is a downwardly facing chamfered surface 656.

The collet support 638 has a first bore 658 and a somewhat smaller second bore 660.

Generally annularly positioned between collet support 638 and collet retainer 642 is a retrieving collet means, characterized in FIG. 4 by a retrieving collet 662. Collet 662 has an upper annular ring portion 664 and a plurality of collet fingers 666, each collet finger 666 having an enlarged lower portion 668. Enlarged lower portion 668 has an annular, upwardly facing shoulder 670 and a downwardly facing chamfered surface 672 thereon.

As retrieving tool 404 is positioned over the upper end of packer plug 400, the tool string is angularly positioned such that lug 654 in collet retainer 642 engages external spline 410 on ring spring nut 406. This provides a means for preventing relative rotation between retrieving tool 404 and plug 400. Also as retrieving tool 404 is lowered onto packer plug 400, it will be seen by those skilled in the art that chamfered surface 672 on enlarged portion 668 of collet fingers 666 engages chamfered surface 456 on ring spring 450 such that the collet fingers flex outwardly, and as retrieving tool 400 is lowered sufficiently, enlarged lower portions 668 of collet fingers 666 will move radially inwardly such that shoulder 670 will be generally positioned below ring spring 450. It will also be clear to those skilled in the art that first bore 658 of collet support 638 is of sufficient size to accommodate this flexing of collet fingers 666.

The tubing string is then raised, and it will be seen that top coupling 632, collet retainer 642 and collet support 638 will slide upwardly with respect to packer plug 400 because of the sliding engagement between lug 654 and spline 410. The engagement of collet 662 with ring spring 450 will hold the collet in place, and collet retainer 642 will slide upwardly with respect thereto, because of the sliding engagement between ring portion 664 of collet 662 and first outside diameter 646 of collet retainer 642. Second bore 660 of collet support 638 will thereby be positioned radially outwardly of enlarged lower portions 668 of collet fingers 666. It will thus be seen that radially outward flexing of collet fingers 666 is thereby prevented.

The tubing string is then raised with sufficient force to shear shear pin 512 such that operating mandrel means 409 may be moved upwardly from its locking position within outer mandrel assembly 468. When this occurs, lower groove 532 is positioned adjacent to collet supports 544 which are then biased inwardly by springs 556 into groove 532. This corresponds to a disengaging position of operating mandrel 412, and collet 558 is again free to flex radially inwardly so that it will be disengaged from threaded portion 46 in packer 10.

Operating mandrel means 409 is raised upwardly with respect to outer mandrel assembly 461 until lower operating mandrel 618 engages the lower end of collet support housing 534. At this point, further lifting on operating mandrel means 409 will also raise outer mandrel assembly 461 and thus disengage collet 558 from threaded portion 46. When this occurs, it will be seen that further upward movement of the tool string and retrieving tool 404 will raise plug 400 out of gravel packer 10 so that the packer may be reused in production.

Thus, only reciprocating motion of the tubing string is necessary to set and retrieve packer plug 400. However, if packer plug 400 becomes jammed into gravel packer 10, the tubing string can be rotated. This is possible because the engagement of lug 654 with external spline 410 transmits the rotational force from top coupling 632 to operating mandrel means 409, and the engagement of lug 541 on operating mandrel 412 with slot 540 in collet support housing 534 transmits rotational force from operating mandrel means 409 to outer mandrel 461 and thus to collet 558. It will be seen by those skilled in the art that even though collet 558 is still engaged with left-hand threaded portion 46 of top sub 28, right-hand rotation of the tubing string will disengage this left-hand threaded engagement so that the tubing string, retrieving tool 404 and packer plug 400 may then be removed from the well bore and from gravel packer 10.

It will be seen, therefore, that the gravel packer plug of the present invention is well adapted to carry out the ends and advantages mentioned as well as those inherent therein. While a presently preferred embodiment of the gravel packer plug and a gravel packer in which it may be used have been shown for the purposes of this disclosure, numerous changes in the arrangement and construction of parts may be made by those skilled in the art. All such changes are encompassed within the scope and spirit of the appended claims.

What is claimed is:

1. An apparatus for plugging a packer set in a well bore, said apparatus comprising:

collet means for engaging an inner portion of said packer;

operating mandrel means for connecting to a tool string and comprising:

a portion defining a upper and lower spaced grooves; and a collet support disposed between said portion and said collet means;

wherein, said portion is movable such that said upper groove may be positioned adjacent to said collet support allowing said collet support to be biased into said upper groove so that said collet means may flex inwardly for engaging said inner portion of said packer, a section of said portion between said grooves may be positioned adjacent to said collet support causing said collet support to lockingly engage said collet means with said inner portion of said packer, and said lower groove may be positioned adjacent to said collet support allowing said collet support to be biased into said lower groove such that said collet means may again flex inwardly for disengaging from said inner portion of said packer; and sealing means for sealingly engaging an inner surface of said packer.

2. The apparatus of claim 1 further comprising filling means for providing communication between said well bore and a central opening defined in said operating mandrel means as said tool string is lowered into said well bore.

3. The apparatus of claim 1 further comprising shoulder means for limiting downward travel of said portion of said operating mandrel means.

4. The apparatus of claim 1 further comprising shearable stop means for limiting upward movement of said portion of said operating mandrel means after engagement of said collet means with said packer and for shearing in response to an upward force on said portion of said operating mandrel means, whereby said portion of said operating mandrel means is actuated to disengage said collet means.

5. The apparatus of claim 1 further comprising:

a ring adjacent to an upper end of said operating mandrel means; and a setting tool attached to said tool string and defining a bore therein adapted for being press fit on an outer portion of said ring and being detachable from said ring upon application of a predetermined upward force on said setting tool.

6. The apparatus of claim 1 further comprising:

a ring adjacent to an upper end of said operating mandrel means; and a retrieving tool attached to said tool string and comprising retrieving collet means thereon for lockingly engaging said ring for raising said operating mandrel means, wherein the first mentioned collet means is disengaged from said packer for retrieving said apparatus.

7. The apparatus of claim 1 further comprising means for preventing relative rotation between said operating mandrel means and and said collet means.

8. An apparatus for plugging a gravel packer of the type having a packer mandrel means with a threaded portion and an inner bore extending therebelow, said apparatus comprising: an outer mandrel assembly comprising:

an upper portion;

an intermediate portion including a collet means thereon for engaging said threaded portion of said packer; and a closed, lower portion having sealing means thereon for sealingly engaging said bore in said packer; and an inner mandrel assembly comprising:

an upper portion;

an intermediate portion having a pair of spaced annular grooves in an outer surface thereof; and a lower portion;

a plurality of collet supports disposed between said intermediate portion of said inner mandrel assembly and said collet means; and biasing means for biasing said collet supports radially inwardly;

wherein, said inner mandrel assembly is vertically movable with respect to said outer mandrel assembly such that an upper one of said grooves is positionable adjacent to said collet supports such that said collet supports are biased into the upper groove such that said collet means may flex inwardly for engaging said threaded portion of said packer when said inner mandrel assembly is in an engaging position, a portion of said inner mandrel assembly between said grooves is positioned adjacent to said collet supports such that said collet supports lockingly engage said collet means with said threaded portion when said inner mandrel assembly is in a locking position, and a lower one of said grooves is positionable adjacent to said collet supports such that said collet supports are biased into the lower groove such that said collet means may again flex inwardly for disengaging from said threaded portion when said inner mandrel assembly is in a disengaging position.

9. The apparatus of claim 8 wherein:

said inner mandrel assembly defines a central opening therethrough and a transverse hole therein in communication with said central opening; and said outer mandrel assembly defines a transverse hole therethrough in communication with said hole in said inner mandrel assembly whereby a filling passageway is formed for filling as said apparatus is run into said well bore.

10. The apparatus of claim 8 wherein said outer mandrel assembly defines an annular groove in an outer surface thereof and further comprising:

a shear sub slidably positioned on said outer mandrel assembly and having a first position below said groove in said outer surface and a second position; and locking dog means for lockingly engaging said groove in said outer surface when said shear sub is in said second position.

11. The apparatus of claim 10 further comprising means for preventing relative rotation of said shear sub and said outer mandrel assembly.

12. The apparatus of claim 8 further comprising means for preventing relative rotation of said inner and outer mandrel assemblies.

13. The apparatus of claim 8 further comprising:

a ring spring attached to said upper end of said inner mandrel assembly; and a setting tool attachable to a tool string and defining a bore engaged by an interference fit with said ring spring.

14. The apparatus of claim 8 further comprising:

a spline on said upper end of said inner mandrel a ring spring attached to said upper end of said inner mandrel assembly below said spline; and a retrieving tool attachable to a tool string and comprising:

a lug engagable with said spline on said inner mandrel assembly;

a retrieving collet slidably disposed below said lug and having collet fingers extending downwardly therefrom; and a collet support having a first position with respect to said collet, wherein said collet fingers may flex outwardly for engaging said ring spring, and a second position, wherein said collet fingers are locked into engagement with said ring spring.

15. The apparatus of claim 8 wherein:

said lower portion of said outer mandrel assembly defines a transverse relief hole therethrough;

said lower portion of said inner mandrel assembly is adjacent to said hole; and further comprising sealing means on said lower portion of said inner mandrel assembly for sealingly closing said relief hole when in a variable first position corresponding to said engaging and locking positions of said inner mandrel assembly and a second position opening said relief hole corresponding to said disengaging position of said inner mandrel assembly, whereby said apparatus drains when removed from said packer.

16. The apparatus of claim 8 further comprising shearable stop means for preventing movement of said inner mandrel assembly to said disengaging position except upon application o a predetermined force thereon.

17. An apparatus for plugging a gravel packer of the type having a packer mandrel means with a threaded portion therein and an inner bore extending below said threaded portion, said apparatus comprising:

a plug comprising:

an operating mandrel defining an upper groove therein and a lower groove spaced from said upper groove;

an outer mandrel adapted for slidingly receiving said operating mandrel therein;

a collet disposed on said outer mandrel adjacent to said grooves in said operating mandrel;

a plurality of collet supports disposed radially inwardly from said collet;

biasing means for biasing said collet supports radially inwardly; and a ring spring attached to an upper end of said operating mandrel;

a setting tool attachable to a tool string and comprising:

a sleeve portion defining a bore therein for engaging by an interference fit an outer surface of said ring spring, whereby said plug may be run into said packer and said operating mandrel actuated downwardly to an engaging position wherein said collet supports are biased into said upper groove, said sleeve portion being adapted for actuating said operating mandrel to a locking position wherein said collet supports are disposed between said grooves and held radially outwardly for locking said collet in engagement with said threaded portion of said packer, and being further adapted for disengaging from said ring spring by application of a predetermined upward force from said tool string; and a retrieving tool for attaching to a tool string and comprising:

a collet support; and a sliding collet disposed adjacent said collet support, said collet being adapted for engaging said ring spring when pushed downwardly thereagainst, said collet support locking said retrieving collet into engagement with said ring spring when moved upwardly by an upward force on said tool string, and adapted for actuating said operating mandrel to a disengaging position wherein said collet supports are biased into said lower groove such that said collet on said outer mandrel may be disengaged from said threaded portion of said packer and said plug removed from said packer.

18. The apparatus of claim 17 further comprising means for preventing relative rotation between said retrieving tool and said operating mandrel of said plug.

19. The apparatus of claim 17 further comprising means for filling said plug and setting tool as said plug and setting tool are lowered into a well bore on said tool string.

20. The apparatus of claim 17 further comprising means for draining said plug when said collet is disengaged from said threaded portion of said packer.

* * * * *

UNITED STATES PATENT AND TRADEMARK OFFICE

CERTIFICATE OF CORRECTION

PATENT NO. : 4,871,018

DATED : October 3, 1989

INVENTOR(S) : Kenneth D. Caskey et al.

It is certified that error appears in the above-identified patent and that said Letters Patent is hereby corrected as shown below:

In column 9, line 47, delete the numeral [38] and insert therefore --3B--.

In column 9, line 68, after the numeral 548 insert --.--

In column 17, line 1, after the word "mandrel" insert the word --assembly--.

In column 17, line 33, delete the letter [o] and insert the word --of--.

Signed and Sealed this

Twelfth Day of March, 1991

*Attest:*

HARRY F. MANBECK, JR.

*Attesting Officer*

*Commissioner of Patents and Trademarks*